US006769587B1

(12) United States Patent
Lomas

(10) Patent No.: US 6,769,587 B1
(45) Date of Patent: Aug. 3, 2004

(54) BELT-MOUNTED GOLF ACCESSORY HOLDER

(76) Inventor: Manny Lomas, 1323 Woodfair Dr., Richmond, TX (US) 77469

( * ) Notice: Subject to any disclaimer, the term of this patent is extended or adjusted under 35 U.S.C. 154(b) by 12 days.

(21) Appl. No.: 10/127,027

(22) Filed: Apr. 22, 2002

(51) Int. Cl.[7] ..... A45C 1/04

(52) U.S. Cl. ..... 224/663; 224/269; 224/660; 224/667; 224/671; 224/674; 224/680; 224/918

(58) Field of Search ..... 224/663, 269, 224/918, 919, 666, 667, 671, 674, 680, 251, 660

*Primary Examiner*—Gregory Vidovich
*Assistant Examiner*—Maerena W. Brevard

(57) ABSTRACT

A belt-mounted golf accessory holder for carrying golf items such as golf balls, tees, and ball markers on one's person. The belt-mounted golf accessory holder includes a container having back, side, bottom, and front walls, and also having a storage compartment disposed therein; and also includes a flexible flap being hingedly attached to the container and being fastenably closable over an open top of the container; and further includes an assembly of fastening the flap to the container; and also includes belt loop members being securely attached to the container for carrying the container upon a user's belt; and further includes a towel support member being connected to the container for supporting a golf towel.

5 Claims, 3 Drawing Sheets

BELT-MOUNTED GOLF ACCESSORY HOLDER

BACKGROUND OF THE INVENTION

1. Field of the Invention

The present invention relates to belt-supported golf accessory holders and more particularly pertains to a new belt-mounted golf accessory holder for carrying golf items such as golf balls, tees, and ball markers on one's person.

2. Description of the Prior Art

The use of belt-supported golf accessory holders is known in the prior art. More specifically, belt-supported golf accessory holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,494,202; U.S. Pat. No. 4,850,483; U.S. Pat. No. 4,356,943; U.S. Pat. No. 1,911,256; U.S. Pat. No. 3,674,189; U.S. Pat. No. 4,893,739; and U.S. Pat. No. Des. 266,201.

While these devices fulfill their respective, particular objectives and requirements, the aforementioned patents do not disclose a new belt-mounted golf accessory holder. The prior art includes inventions having pouch-like members attachable to one's golf bags.

SUMMARY OF THE INVENTION

The general purpose of the present invention, which will be described subsequently in greater detail, is to provide a new belt-mounted golf accessory holder which has many of the advantages of the belt-supported golf accessory holders mentioned heretofore and many novel features that result in a new belt-mounted golf accessory holder which is not anticipated, rendered obvious, suggested, or even implied by any of the prior art belt-supported golf accessory holders, either alone or in any combination thereof. The present invention includes a container having back, side, bottom, and front walls, and also having a storage compartment disposed therein; and also includes a flexible flap being hingedly attached to the container and being fastenably closable over an open top of the container; and further includes an assembly of fastening the flap to the container; and also includes belt loop members being securely attached to the container for carrying the container upon a user's belt; and further includes a towel support member being connected to the container for supporting a golf towel. None of the prior art includes containers which are supported upon one's person.

There has thus been outlined, rather broadly, the more important features of the belt-mounted golf accessory holder in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new belt-mounted golf-accessory holder which has many of the advantages of the belt-supported golf accessory holders mentioned heretofore and many novel features that result in a new belt-mounted golf accessory holder which is not anticipated, rendered obvious, suggested, or even implied by any of the prior art belt-supported golf accessory holders, either alone or in any combination thereof.

Still another object of the present invention is to provide a new belt-mounted golf accessory holder for carrying golf items such as golf balls, tees, and ball markers on one's person.

Still yet another object of the present invention is to provide a new belt-mounted golf accessory holder that is easy and convenient to use.

Even still another object of the present invention is to provide a new belt-mounted golf accessory holder that makes it easy for the user to find the golf items needed to play the game without the user having to search through one's golf bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
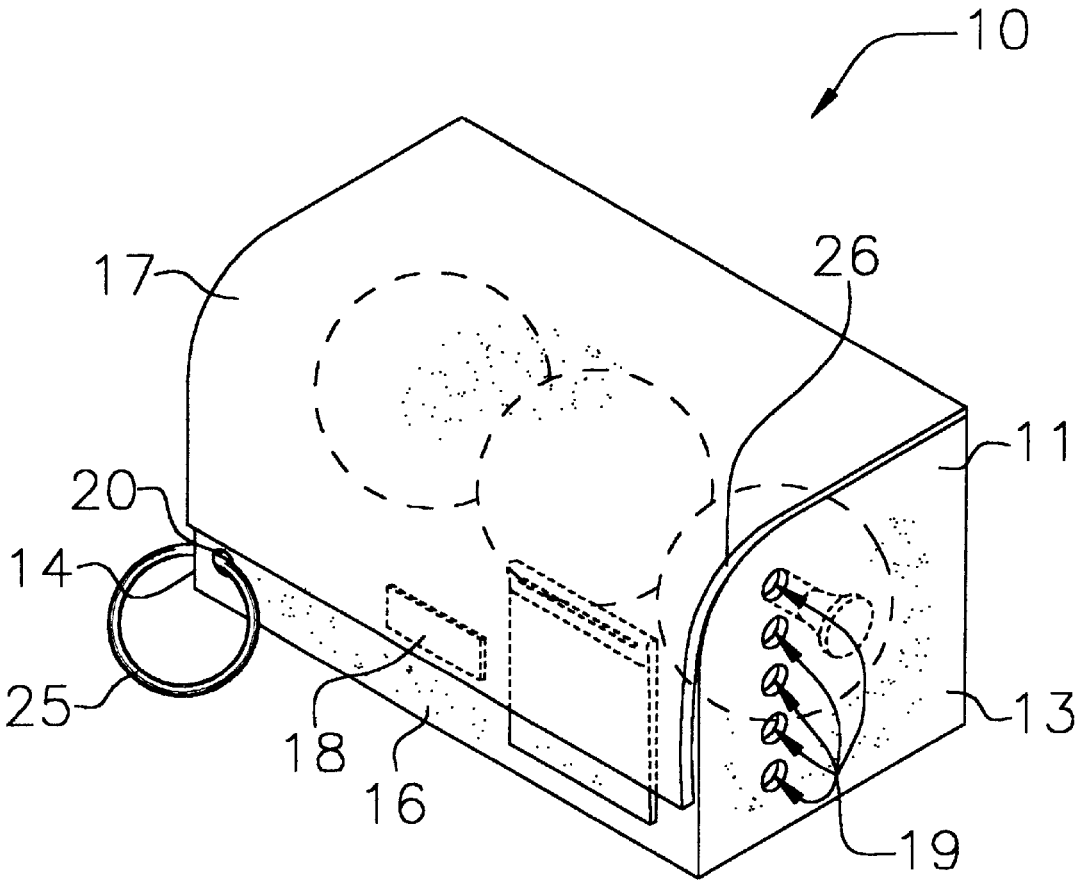
FIG. 1 is a perspective view of a new belt-mounted golf accessory holder according to the present invention.
Figure 2:
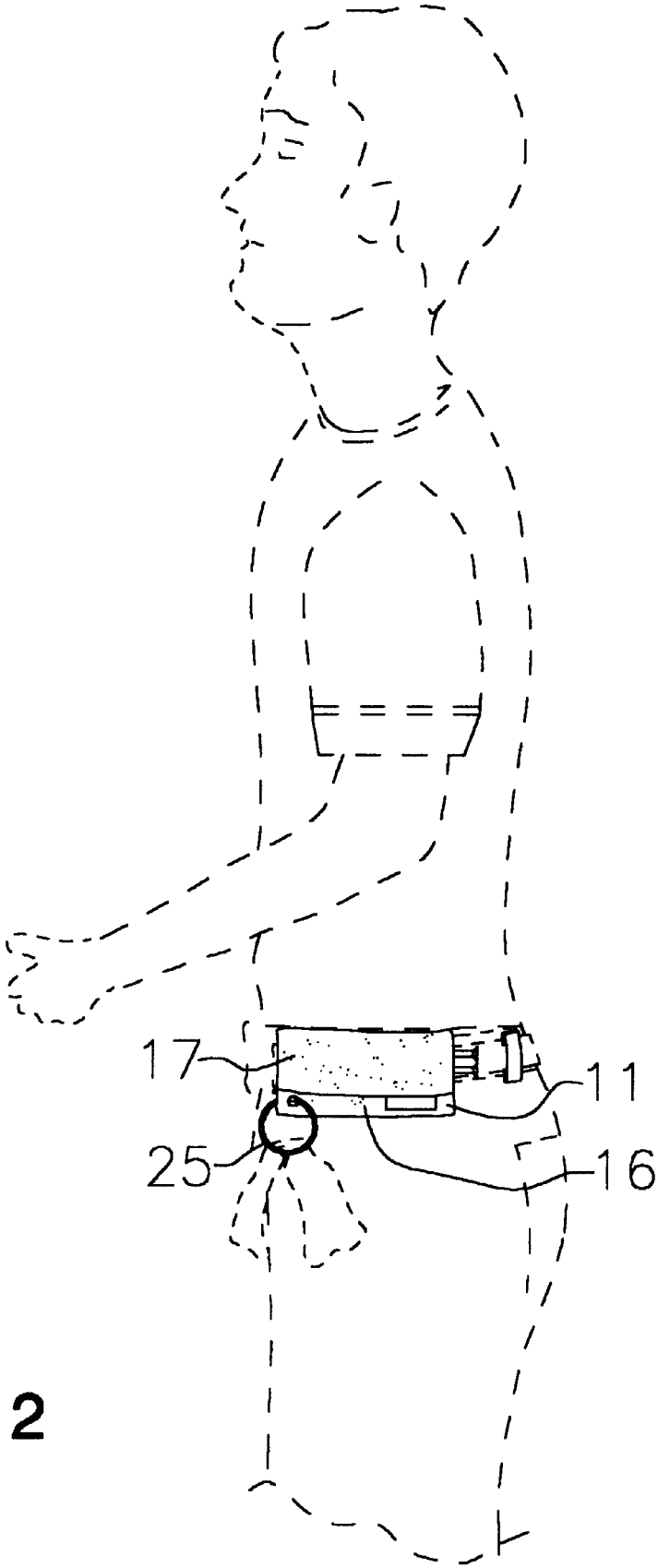
FIG. 2 is a front elevational view of the present invention shown in use.
Figure 3:
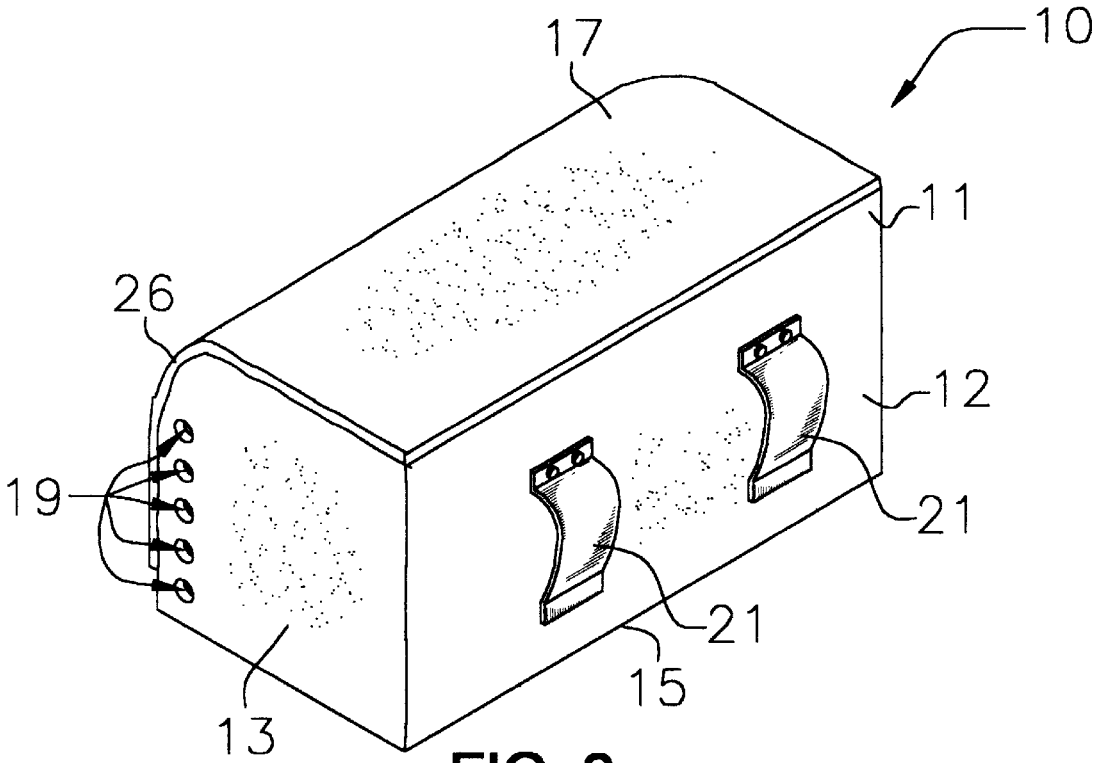
FIG. 3 is a rear perspective view of the present invention.
Figure 4:
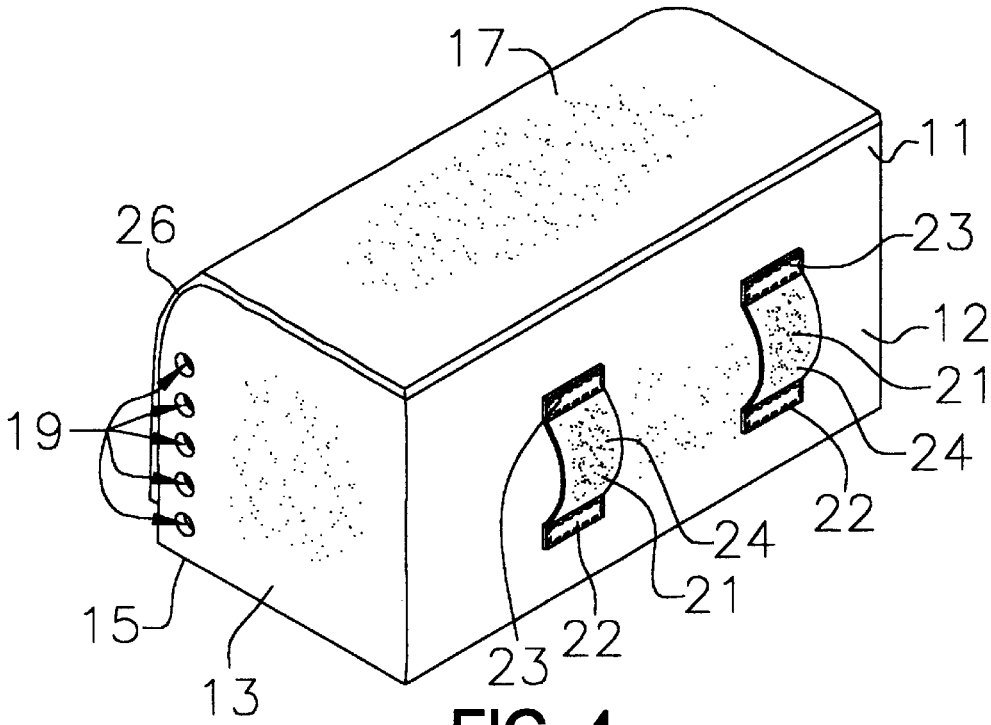
FIG. 4 is a rear perspective view of a second embodiment of the present invention.

With reference now to the drawings, and in particular to FIGS. 1 through 4 thereof, a new belt-mounted golf accessory holder embodying the principles and concepts of the present invention and generally designated by the reference numeral 10 will be described.

As best illustrated in FIGS. 1 through 4, the belt-mounted golf accessory holder 10 generally comprises a container 11 having back, side, bottom, and front walls 12–16, and also having a storage compartment disposed therein. The side walls 13, 14 include first and second side walls having rounded corners 26 connecting front and top edges thereof. The container 11 has a length which is greater than a width and a depth thereof. The container 11 further includes a plurality of holes 19 being spacedly disposed through the first side wall 13 and being aligned in a column near the front edge thereof and extending from near a bottom edge of the first side wall 13 to near the top edge thereof with the holes 19 being adapted to receive and hold shaft portions of tees. The container 11 further includes a pair of apertures 20 one of which is disposed through the front wall 16 and the other of which is disposed through the second side wall 14.

A flexible flap is hingedly and conventionally attached to the container 11 and is fastenably closable over an open top of the container 11. A means of fastening the flap 17 to the container 11 includes strips of hook and loop fasteners 18 being conventionally attached to an exterior of the front wall 16 and to an underside of the flap 17 near a front edge thereof with the strips of hook and loop fasteners 18 being fastenable to one another to close the flap 17 over the open top of the container 11.

Belt loop members 21 are securely and conventionally attached to the container 11 for carrying the container 11 upon a user's belt. The belt loop members 21 are strips of material having ends 22–23 being securely and conventionally attached to an exterior of the back wall 12 thus forming openings between the back wall 12 and main portions 24 of the strips of material 21 with the strips of material 21 being spaced apart and being arranged generally parallel to one another with the openings being in general alignment. A towel support member 25 is connected to the container 11 for supporting a golf towel. The towel support member 25 is a ring being disposed through the apertures 20 of the container 11.

In use, the user extends one's belt through the openings of the belt loop members 21, and places accessory golf items such as golf balls and ball markers in the storage compartment of the container 11, and closes the flap 17 over the open top of the container 11, and inserts the shaft portions of tees in the holes 19 in the first side wall 13 so that the user has easy access to the tees when needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the belt-mounted golf accessory holder. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A belt-mounted golf accessory holder comprising:

a container having back, side, bottom, and front walls, and also having a storage compartment disposed therein, said side walls including first and second side walls having rounded corners connecting front and top edges thereof, said container having a greater length than a width and a depth thereof, said container further including a plurality of holes being spacedly disposed through said first side wall and being aligned in a column near said front edge thereof and extending from near a bottom edge of said first side wall to near said top edge thereof, said holes receiving and holding shaft portions of tees;

a flexible flap being hingedly attached to said container and being fastenably closable over an open top of said container;

a means of fastening said flap-like cover to said container;

belt loop members being securely attached to said container for carrying said container upon a user's belt; and a towel support member being connected to said container for supporting a golf towel.

2. A belt-mounted golf accessory holder as described in claim 1, wherein said container further includes a pair of apertures one of which is disposed through said front wall and the other of which is disposed through said second side wall.

3. A belt-mounted golf accessory holder as described in claim 2, wherein said means of fastening said flap to said container includes strips of hook and loop fasteners being attached to an exterior of said front wall and to an underside of said flap near a front edge thereof, said strips of hook and loop fasteners being fastenable to one another to close said flap over said open top of said container.

4. A belt-mounted golf accessory holder as described in claim 3, wherein said belt loop members are strips of material having ends being securely attached to an exterior of said back wall thus forming openings between said back wall and main portions of said strips of material, said strips of material being spaced apart and being arranged generally parallel to one another with said openings being in general alignment.

5. A belt-mounted golf accessory holder as described in claim 4, wherein said towel support member is a ring being disposed through said apertures of said container.

* * * * *